US011021308B2

(12) United States Patent
Kunz

(10) Patent No.: US 11,021,308 B2
(45) Date of Patent: Jun. 1, 2021

(54) CONTAINER COMPRISING A RECESS IN THE CONTAINER WALL

(71) Applicant: ALPLA WERKE ALWIN LEHNER GMBH & CO. KG, Hard (AT)

(72) Inventor: Johann Kunz, Hard (AT)

(73) Assignee: ALPLA WERKE ALWIN LEHNER GMBH & CO. KG

( * ) Notice: Subject to any disclaimer, the term of this patent is extended or adjusted under 35 U.S.C. 154(b) by 0 days.

(21) Appl. No.: 15/779,271

(22) PCT Filed: Nov. 24, 2016

(86) PCT No.: PCT/EP2016/078685
§ 371 (c)(1),
(2) Date: May 25, 2018

(87) PCT Pub. No.: WO2017/089464
PCT Pub. Date: Jun. 1, 2017

(65) Prior Publication Data

US 2018/0327162 A1 Nov. 15, 2018

(30) Foreign Application Priority Data

Nov. 25, 2015 (CH) ..... 01719/15

(51) Int. Cl.
*B65D 79/02* (2006.01)
*B65D 81/26* (2006.01)
*B65D 79/00* (2006.01)

(52) U.S. Cl.
CPC ..... *B65D 79/005* (2013.01); *B65D 79/02* (2013.01); *B65D 81/266* (2013.01)

(58) Field of Classification Search
CPC ..... B65D 79/005; B65D 79/02; B65D 81/266
USPC ..... 220/661; 215/11.4, 380, 383, 386
See application file for complete search history.

(56) References Cited

U.S. PATENT DOCUMENTS 1,348,062 A * 7/1920 Shook ..... B65D 1/06 215/380
1,906,493 A * 5/1933 Staats ..... B43L 25/00 141/112
2,861,714 A * 11/1958 Glossop ..... B65D 7/045 206/522
4,113,129 A * 9/1978 Cambio, Jr. ..... A61J 1/05 215/380
4,419,323 A * 12/1983 Winchell ..... A61J 1/1406 215/380

(Continued)

FOREIGN PATENT DOCUMENTS

EP 1068902 1/2001
EP 1651535 5/2006

(Continued)

*Primary Examiner* — J. Gregory Pickett
*Assistant Examiner* — Niki M Eloshway
(74) *Attorney, Agent, or Firm* — Morriss O'Bryant Compagni Cannon, PLLC

(57) ABSTRACT

The invention relates to a plastic container having a container wall delimiting an interior of the container, and an outlet on the container wall for pouring out a product contained in the plastic container. A recess that projects into the interior of the container and is provided for accepting a functional element is formed on the container wall, with the recess being accessible through an insertion hole.

20 Claims, 3 Drawing Sheets

(56) References Cited

U.S. PATENT DOCUMENTS

| | | | | | |
|---|---|---|---|---|---|
| 4,932,542 | A * | 6/1990 | Chen | A47G 19/2227 | 215/374 |
| 4,964,522 | A * | 10/1990 | Umetsu | B29C 49/20 | 215/383 |
| 5,201,431 | A * | 4/1993 | Berger | B65D 23/12 | 215/383 |
| 5,897,010 | A * | 4/1999 | Soyka, Jr. | B65D 23/12 | 215/383 |
| 7,926,682 | B2 * | 4/2011 | Nelson | B01F 15/0205 | 141/330 |
| 2002/0104815 | A1 * | 8/2002 | Richards | A61J 9/001 | 215/11.1 |
| 2006/0054635 | A1 * | 3/2006 | Iwahashi | A61F 9/0008 | 222/107 |

FOREIGN PATENT DOCUMENTS

| | | |
|---|---|---|
| EP | 2227369 | 9/2010 |
| GB | 2524843 | 10/2015 |
| WO | WO2005037040 | 4/2005 |
| WO | WO2010081081 | 7/2010 |
| WO | WO2014000776 | 1/2014 |

* cited by examiner

CONTAINER COMPRISING A RECESS IN THE CONTAINER WALL

CROSS-REFERENCE TO RELATED APPLICATIONS

This application is a national phase entry under 35 U.S.C. § 371 of PCT/EP2016/078685 filed on Nov. 24, 2016, which claims priority to Swiss Patent Application No. 01719/15 filed on Nov. 25, 2015, the entirety of each of which is incorporated by this reference.

FIELD OF THE INVENTION

The invention relates to a container produced from a plastic material comprising a container wall delimiting a container interior and an outlet opening provided on the container wall for emptying a product which can be accommodated in the plastic container.

PRIOR ART

If containers are filled with hot liquids or other contents and closed immediately after the filling procedure, a partial vacuum results in the container interior after the cooling of the content, whereby the walls of the container can partially collapse. Such containers are aesthetically unattractive and cannot be placed correctly in the shelves in this form. To prevent collapsing of the walls, the containers are equipped with a ventilation valve. This valve can be produced from an air-permeable, porous material. The ventilation valve is typically integrated into the closure cap, because it may be installed most easily therein. Ventilation valves made of porous material can also be used, however, to protect the content of the container from microbes and bacteria. For design or functional reasons, an arrangement of the ventilation valve in the closure of the container is not always the optimum location. The demand therefore exists for enabling greater flexibility in the arrangement of the ventilation valve.

A closure cap is known from WO 2010/081081, in which a porous element is integrated, to enable a pressure equalization between the container interior and the surroundings. The closure cap according to WO 2010/081081 has a chamber at the lower side of the cover, which has two openings, a lower opening, through which the porous element is inserted into the chamber, and an upper passage opening, which connects the chamber to the surroundings. In order that the porous element is held in the chamber, it can be dimensioned such that a press fit is implemented. Alternatively, the lower edge of the chamber can be folded or provided with an undercut.

EP-A-1 068 902 discloses a closure arrangement consisting of an elastic plug for closing a container opening and a filter medium, which is integrated into the plug. The plug has an axial opening, which enables a connection between the container interior and the surroundings. A filter disk, which presses against the cylindrical wall of the passage to form a seal, is arranged in the opening of the plug. It is proposed that the filter disk in the opening be formed integrally with the plug in the injection molding method. However, EP-A-1 068 902 does not provide any instructions as to how this could be implemented.

Advantage of the Invention

An advantage of the present invention is to disclose a holding device for functional elements on a container, which can also be provided at points other than the container closure.

SUMMARY OF THE INVENTION

The invention relates to a plastic container comprising a container wall and an outlet opening.

The invention provides a container that is formed by extrusion blowmolding and has a recess protruding into the container interior formed on the container wall for accommodating a functional element, wherein the recess is accessible through an insertion opening. The recess can be formed at any point of the container wall and is shaped such that the functional element is securely held in the recess after insertion through the insertion opening. If the container wall is broken through to ensure a contact of the inserted functional element with a product stored in the container interior, the functional element can be held using the container wall sealed in such a manner that a product stored in the container interior cannot reach the surroundings between container wall and functional element. Because the recess is oriented inward, the container surface remains smooth and is not impaired by protrusions. The design of the container can be made extremely flexibly, because it is not impaired by position specifications of the recess. The method of extrusion blowmolding enables the container to be produced rapidly and with accurate dimensions.

In one particular embodiment, the recess has a canopy at least in a subregion, which is formed by a section of the container wall delimiting the insertion opening. The canopy ensures that the functional element is securely held in a formfitting manner in the recess, which is used as a receptacle chamber. The canopy can be formed linearly, convexly, or concavely transversely to a center axis of the recess. The container wall can also be formed in this section as a tooth in a canopy over the recess having sharp or rounded tooth head. The recess can also be covered in more than one subregion. The canopy can be used to fix the functional element in the axial direction. The canopy can be formed such that the functional element is fixed in a removable or nonremovable manner. The removability can be ensured by axial force action or radial force action or by a combination of both force actions.

The recess advantageously has a wall and a base. The functional element or the insert can thus be pressed into the recess until it strikes against the base. The wall can be formed pyramidal or cylindrical, for example, and can form a polygon in each case viewed in the direction of a longitudinal extension direction of the recess. The wall can also be formed oval, elliptical, or circular viewed in the direction of a longitudinal extension direction of the recess. The recess can also be formed comprising a step, which is formed as a support surface or stop surface for the functional element. However, the wall will usually be formed as circular-cylindrical.

Because a passage opening is advantageously provided on the base and/or the wall of the recess, the functional element is connected to the container interior. The opening will generally be arranged such that with inserted functional element, no escape of the product takes place past the functional element. A permanent connection between the atmosphere enclosing the container and the container interior is formed in addition to the outlet opening by the passage opening.

To simplify the demolding of the container, the recess has a center axis that is essentially perpendicular to the container wall.

According to a further exemplary embodiment, however, it is also conceivable that the recess has a center axis which encloses an angle with the container wall which is less than 90° and greater than 0°, less than 88° and greater than 10°, or less than 80° and greater than 15°. The orientation of the recess in relation to the container surface is thus flexibly selectable. This is advantageous if a special container contour is required or the insertion opening is to be as unobtrusive as possible. In one exemplary embodiment, the angle is less than 45° and greater than 30°. The enclosed angle includes both an angle in the vertical direction and also in the horizontal direction. The direction specification can be related in this case to the footprint of the container. Thus, for example, the center axis can stand perpendicular on the container wall in the horizontal direction and the enclosed angle between container wall and center axis of the recess can be, for example, 75° in the vertical direction. The insertion opening advantageously has a first clear width and the recess widens to a second clear width in the direction of the container interior, wherein the second clear width is greater than the first clear width. The recess can thus enclose the functional element and hold it in a formfitting manner.

In a further embodiment, the insertion opening has a first clear width and the recess widens in the direction of the container interior in relation to the first clear width to a second clear width and subsequently constricts to a third clear width. This design of the recess is advantageous if the functional element is inserted with its smaller-diameter end in front into the recess. The recess is embodied in this case such that it encloses the lateral surface of the functional element and the undercut holds the larger-diameter end in a formfitting manner. The constriction from the second clear width to the third clear width can take place suddenly, for example, by means of an offset, a step, or a projection. This constriction from the second clear width to the third clear width can also take place continuously or discontinuously over a predetermined distance. The first clear width can be smaller than, equal to, or larger than the third clear width.

It has proven to be advantageous if the maximum canopy of the recess measured transversely to a center axis of the recess is between 0.05 mm and 1 mm or between 0.25 mm and 0.5 mm. Due to these dimension features, the canopy has an overlap with respect to the recess which holds the functional element reliably in the recess, on the one hand, and enables the functional element to be pressed through the insertion opening, on the other hand. The maximum canopy is the amount between the edge of the canopy which simultaneously delimits the insertion opening, and the wall of the recess.

Because the wall of the recess and a section of the canopy adjoining the wall of the recess advantageously enclose an angle between 20 and 50° or between 30 and 40°, the undercut can be demolded and forms a sufficient friction lock for the connection of functional element and recess.

The recess advantageously has an essentially rotationally-symmetrical design. The recess is simpler to demold than if it had a polygonal formation. Fits between functional element and recess are also simpler to perform if they have a rotationally-symmetrical shape.

A further aspect of the invention relates to an above-described container having a functional element accommodated in the recess. Due to the combination of recess and functional element, they can be adapted accurately to one another, whereby the fitting surface between functional element and recess wall is generally liquid-tight, but can also be designed as gas-tight in the case of special demands.

In another particular embodiment, an outer shape of the functional element and an inner shape of the recess correspond to one another such that the functional element is held fluid-tight in the recess in relation to a product stored in the container interior. The fitting surface between functional element and wall of the recess can be embodied as liquid-tight. The form fit, caused by the canopy, holds the functional element reliably in the recess, even if an overpressure prevails in the container interior. The canopy can prevent the functional element from being displaceable out of the recess in the direction of the center axis of the recess. The functional element is advantageously formed as a collar bushing. The functional element is adapted in its outer contour by the formation of the collar to the contours of the recess and is thus accommodated in a particularly well-holding and well-sealing manner in the recess. The functional element can also have the form of a sleeve or a bushing without collar.

A second passage opening is advantageously provided on the functional element, to enable a gas exchange between container interior and the surroundings. Depending on the function of the functional element, it can be directly in contact with the container interior, to equalize pressure or fulfill other tasks described below. The second passage opening can be smaller than 5 μm, to hold back products from the container interior, and can be smaller than 20 μm, to hold back pasty products from the container interior. At both opening sizes, an unobstructed gas exchange is possible between surrounding atmosphere and container interior. The second passage opening is closed by a gas-permeable membrane for the pressure equalization between container interior and surroundings. The membrane is only permeable to gases and is liquid-tight. If an internal pressure which is greater than the ambient pressure builds up in the container interior due to a change of sea level or due to gas formation, this internal pressure can thus be equalized through the membrane. It is also conceivable that a partial vacuum in the container can be equalized. A partial vacuum can arise, for example, if a hot product is poured into the container and is cooled in the closed container.

The membrane function can be implemented in simplified form by the functional element advantageously being a sintered, porous part made of HDPE. The functional element is in one piece and is accordingly also easily producible. Gas can be exchanged between container interior and surroundings through the porous part, but liquid cannot pass through the functional part.

In a further embodiment, the functional element is a shelf life indicator. The shelf life indicator is connected to the container interior and reacts to parameters which permit a change in the filled product to be concluded. Thus, for example, the formation of a gas or a pressure change can be recognized.

A further possibility is that the functional element contains a chemical substance, which can be in fluid connection with the container interior. Thus, for example, the continuous additional metering of a natural antimicrobial substance can lengthen the shelf life of the filled product. The chemical substance can also be an odor absorber, oxygen absorber, water vapor absorber, or a $CO_2$ absorber. In general, a chemical substance can be placed in the functional element, which captures gases arising during the storage of the container.

It is also conceivable that the functional element is an indicator which indicates if the refrigeration chain of the product stored in the container was interrupted.

BRIEF DESCRIPTION OF THE DRAWINGS

Further advantages and features result from the following description of an exemplary embodiment of the invention with reference to the schematic illustrations. In the figures, which are not to scale.

DETAILED DESCRIPTION OF THE INVENTION

Figure 1:
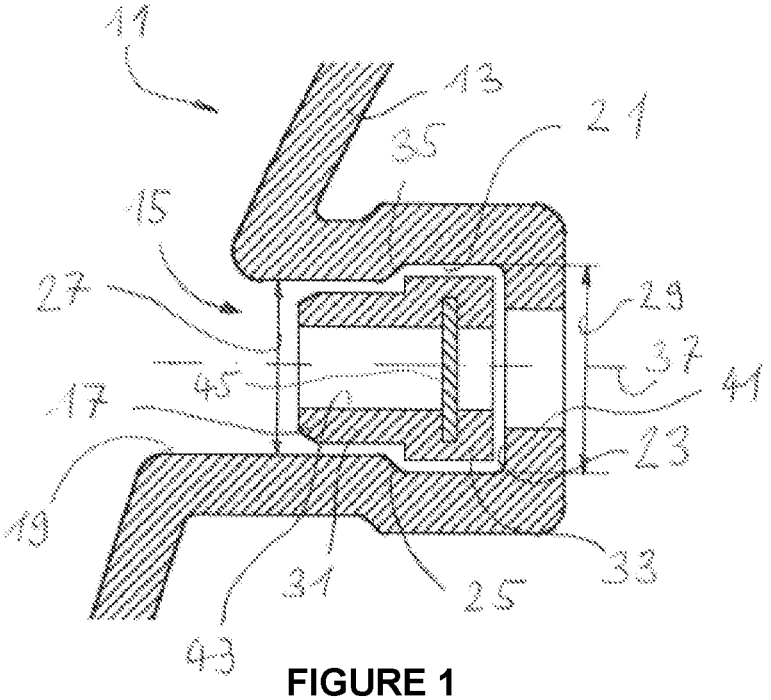
FIG. 1: shows a cross section through the container wall of a plastic container comprising a recess in a first embodiment.
Figure 2:
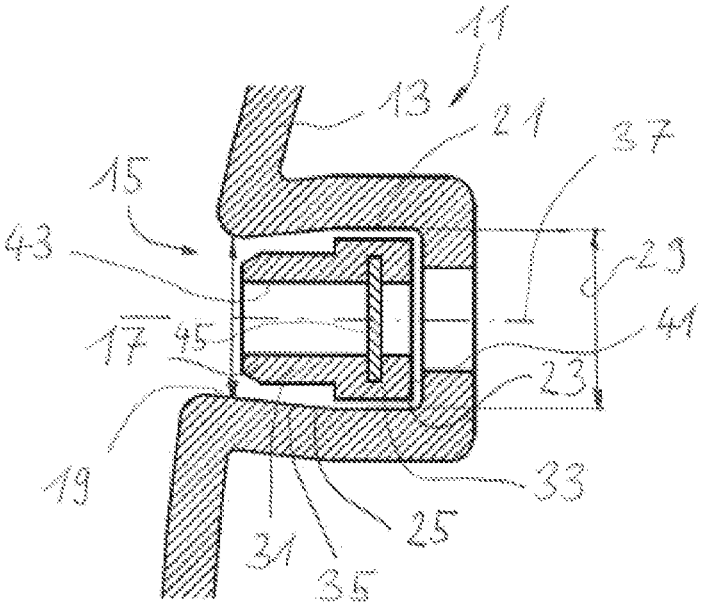
FIG. 2: shows a cross section through the container wall of a plastic container comprising a recess in a second embodiment.
Figure 3:
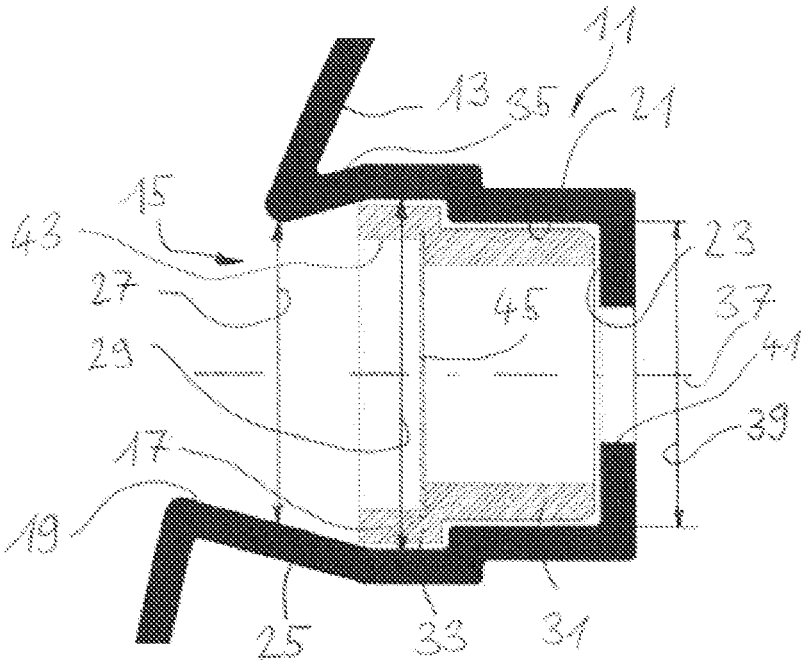
FIG. 3: shows a cross section through the container wall of a plastic container comprising a recess in a third embodiment.
Figure 4:
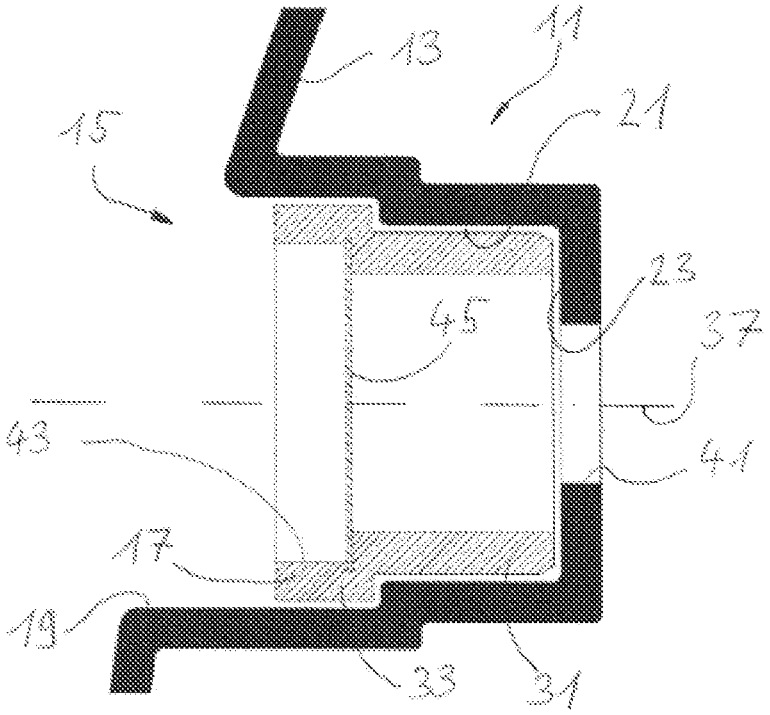
FIG. 4: shows a cross section through the container wall of a plastic container comprising a recess in a fourth embodiment.
Figure 5:
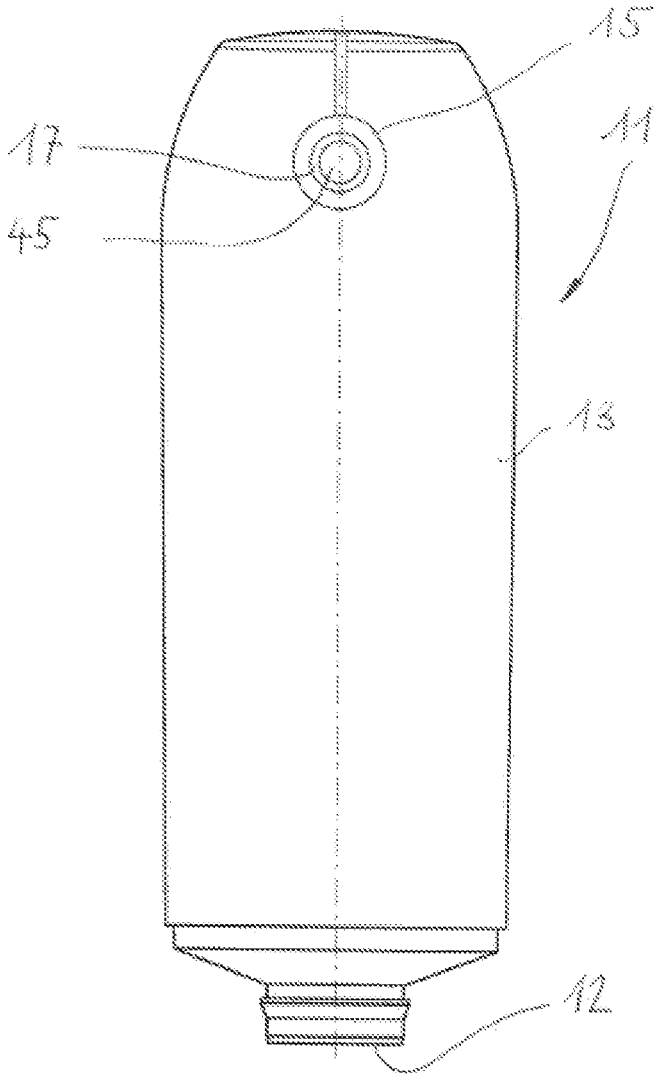
FIG. 5: shows a side view of a plastic container comprising a recess.

A detailed view of a container made of plastic material is shown in FIGS. 1 to 4. The container is identified in its entirety with the reference sign 11. A recess 15 is formed in a container wall 13 of the container 11 at an arbitrary point. The recess 15 is used as a receptacle chamber for a functional element 17. The functional element 17 is inserted through an insertion opening 19 into the recess 17. In FIG. 5, the recess 15 is provided by way of example in the container wall 13 of the container 11, which is formed in the present exemplary embodiment as a side wall, in the vicinity of the container bottom. The recess 15 is arranged at a point at which the functional element 17 can be in contact with the product stored in the container 11, even if the container is partially emptied. Any position on the container wall 13 is possible in principle.

The recesses or the receptacle chamber 15, respectively, has, in addition to the insertion opening 19, a wall 21 and a base 23. If the functional element 17 is accommodated in the recess 15, it is may be configured to touch the base 23. The functional element 17 can be held in a friction-locked and/or formfitting manner in the recess 15. The external dimensions of the functional element 17 and the internal dimensions of the recess 15 are adapted to one another for holding under friction lock such that a press fit is provided. Holding under friction lock is shown in FIG. 4.

For holding the functional element 17 in the recess 15 with a form fit, the recess 15 has a canopy 25. To form the canopy 25, the recess 15 has a first clear width 27 in the region of the insertion opening 19, which widens in the direction of the container interior to a second clear width 29. The external dimensions of the functional element 17 are essentially adapted to the canopy dimensions. For this purpose, the functional element 17 widens from a collar 31 to a larger-diameter shoulder 33.

The difference between first and second clear width 27, 29 is between 0.6 and 1 mm or between 0.7 and 0.9 mm. This difference enables reliable holding of the functional element 17 in the recess 15 and enables the shoulder 33 to still fit through the smaller-diameter insertion opening 19 with widening thereof.

The transition between first and second clear width 27, 29 is formed by a canopy flank 35. The flank 35 forms an angle between 20 and 50° or between 30 and 40° with the wall 21 and/or the center axis 37 of the recess.

If the center axis 37 is perpendicular to the partition plane of the container 11, the canopy is thus simpler to demold than with another orientation of the center axis 37. This is because the half shells of the container open in the direction of the center axis 37. However, it is also conceivable that the center axis has an angle between 0 and 90°, between 10 and 88°, and or between 15 and 80° and the recess 15 is nonetheless demoldable. Movable elements in the mold are also conceivable to implement the demolding. Recesses 15 having such an orientation are desired if the container design requires it. For example, an orientation of the center axis 37 perpendicular to the container surface is advantageous for a uniform container design.

It is also conceivable that according to FIG. 3, the recess 15 constricts proceeding from the second clear width 29 to a third clear width 39. This design of the recess 15 is selected if the functional element 17 is accommodated with the collar 31 in front in the recess 15.

For reasons of simplified production, the functional element 17 and the recess 15 may have a rotationally-symmetrical design.

To enable a fluid exchange between container interior and surroundings, a first passage opening 41 can be provided at the base of the recess 15. It is obvious that for this reason a second passage opening 43 can also be provided at the functional element 17. As FIGS. 3 and 4 show, the second passage opening 43 can be set back in accordance with the outer contour of the functional element 17.

The functional element 17 can perform greatly varying tasks. The following applications are conceivable by way of example and therefore not as an exhaustive list:

As shown in the figures, the functional element 17 can be a housing having the second passage opening 43 provided therein. A membrane 45 is inserted into the second passage opening 43. Since the membrane is expediently only permeable to gases, the same pressure always prevails in the container interior as in the surroundings. A gas exchange therefore takes place between container interior and the atmosphere enclosing container 11. A deformation of the container 11 because of partial vacuum or overpressure in the container interior can therefore be prevented. The membrane 45 can be produced from typical membrane materials, for example, polyethylene (PE) or polytetrafluoroethylene (PTFE), polyamide (PA), or polyacrylonitrile.

A simplified membrane function of the functional element 17 can be achieved in that the functional element 17 is a sintered, porous plug, for example, made of HDPE. This porous material has the properties of a gas-permeable membrane.

The functional element 17 can also be a shelf life indicator. It is connected for this purpose to the container interior. If a gas should form in the container interior, which permits the end of the shelf life of the field product to be concluded, the functional element can thus change the color. For example, a chemical substance can be present in the functional element, which changes the color by reacting with the gas arising.

It is also conceivable that a chemical substance is contained in the functional element 17 which can be emitted through the first and second passage opening 41, 43 into the container interior. The shelf life of the stored product can thus be lengthened.

A chemical substance can also be placed in the functional element 17, which indicates an interruption of the refrigeration chain and thus suggests a spoiled food in the container.

The container 11 having the above-described recess 15 may be produced in the production method of extrusion blowmolding. The method described in EP 2 227 369 represents one possibility for the production.

A displaceable mandrel can be provided in one of the mold half shells for producing the canopy 25. Upon opening of the half shells, the mandrel is displaced from the mold half shell into the cavity at the same velocity as the separation of the mold half shells takes place, and therefore the mandrel does not move in relation to the container upon opening of the mold half shells. The mandrel is then withdrawn from the molded recess 15, wherein the container is held back by a counter holder.

If the recess 15 is formed as in FIG. 4, the mandrel can thus be drawn out of the recess 15 upon opening of the half shells, without a counter holder being necessary for holding back the container.

The invention claimed is:

1. A container produced from a plastic material, comprising:

a container wall delimiting a container interior and a container exterior; and an outlet opening provided on the container wall for emptying a product that can be stored in the plastic container;

the container wall formed by extrusion blowmolding and defining a recess protruding into the container interior, the recess having a first passage opening at a base of the recess in fluid communication with the container interior, the recess forming a receptacle chamber with an enclosed sidewall formed on the container wall, wherein the recess is accessible through an insertion opening on the container exterior;

a functional element configured to be insertable within the recess and, when inserted, enclosed thereby without extending into the container interior where the product can be stored, wherein a fitting surface between an outer shape of the functional element and a wall of the recess is configured such that the functional element is held fluid-tight in the recess in relation to the product that can be accommodated in the plastic container in the container interior, the functional element having a second passage opening to enable a fluid exchange between inside the container interior and outside the container interior.

2. The container of claim 1, wherein the recess has a canopy at least in a subregion, which is formed by a section of the container wall delimiting the insertion opening.

3. The container of claim 2, wherein the recess has a wall and a base.

4. The container of claim 3, further comprising a passage opening in at least one of the base or the wall of the recess.

5. The container of claim 2, wherein a maximum width of the canopy of the recess measured transversely to a center axis of the recess is between 0.05 mm and 1 mm or between 0.25 and 0.5 mm.

6. The container of claim 3, wherein the wall of the recess and a section of the canopy adjoining the wall of the recess enclose an angle between 20 and 50° or between 30 and 40°.

7. The container of claim 1, wherein the recess has a center axis that is essentially perpendicular to the container wall.

8. The container of claim 1, wherein the recess has a center axis that encloses an angle with the container wall and that is less than 90 and greater than 0°, less than 88 and greater than 10°, or less than 80 and greater than 15°.

9. The container of claim 1, wherein the insertion opening has a first width and the recess widens in a direction of the container interior to a second width, wherein the second width is greater than the first width.

10. The container of claim 1, wherein the insertion opening has a first width and the recess widens in a direction of the container interior in relation to the first width to a second width and constricts to a third width.

11. The container claim 1, wherein the recess has an essentially rotationally-symmetrical shape.

12. The container of claim 1, wherein the second passage opening is closed by a gas-permeable membrane.

13. The container of claim 1, wherein the functional element is a sintered, porous part made of HDPE.

14. The container of claim 1, wherein the functional element comprises a shelf life indicator.

15. The container of claim 1, wherein the functional element comprises a substance in fluid communication with the container interior.

16. The container of claim 15, wherein the substance comprises at least one of an antimicrobial substance, an odor absorber, an oxygen absorber, a water vapor absorber or a $CO_2$ absorber.

17. The container of claim 1, wherein the recess encloses a lateral surface of the functional element and an undercut holds the functional element relative to the recess in a formfitting manner.

18. The container of claim 1, wherein a canopy of the recess has an overlap with respect to the recess that holds the functional element in the recess and enables the functional element to be pressed through an insertion opening.

19. The container of claim 1, wherein the recess forms a chamber having a base, sidewalls and an opening configured for receiving the functional element.

20. The container of claim 1, wherein the functional element is pressed into the chamber until it abuts the base of the chamber.

* * * * *